United States Patent [19]

Hunt

[11] 4,422,610

[45] Dec. 27, 1983

[54] FLOWER POT HOLDER

[75] Inventor: Vicki L. Hunt, Clearwater, Fla.

[73] Assignee: Ron-Vik, Incorporated, Minneapolis, Minn.

[21] Appl. No.: 262,312

[22] Filed: May 11, 1981

[51] Int. Cl.[3] ..... A47K 1/08

[52] U.S. Cl. ..... 248/311.2; 47/39; 47/67; 248/558

[58] Field of Search ..... 248/558, 312.1, 313, 248/311.2; 47/66, 41 R, 39, 67 R; 248/490, 488

[56] References Cited

U.S. PATENT DOCUMENTS

| | | | |
|---|---|---|---|
| 1,170,414 | 2/1916 | Christensen | 248/312.1 |
| 2,266,294 | 12/1941 | Allderdice | 248/312.1 |
| 2,461,114 | 2/1949 | Goldberg | 248/488 |
| 2,681,194 | 6/1954 | Halvorsen | 248/490 |
| 3,193,234 | 7/1965 | Thurman et al. | 248/312.1 |
| 3,414,311 | 12/1968 | Trimboli | 248/312.1 |
| 4,071,976 | 2/1978 | Chernewski | 248/312.1 |
| 4,283,038 | 8/1981 | Kurtz | 248/478 |

*Primary Examiner*—William H. Schultz
*Assistant Examiner*—Ramon O. Ramirez
*Attorney, Agent, or Firm*—Merchant, Gould, Smith, Edell, Welter & Schmidt

[57] ABSTRACT

The disclosure is directed to a flower pot holder consisting of a base element secured to a vertical support surface, and a clamping member which is vertically adjustable relative thereto and held in a desired, fixed position by the mounting screw. The base element comprises a first abutment extending laterally from the base, and which cooperates with the clamping member to define a retaining enclosure for the stepped collar of a clay flower pot. A second abutment is vertically spaced below the first abutment and also extends laterally outward from the base element. The first and second abutments are disposed to offer lateral support to the frustoconical wall of the flower pot, while the first abutment underlies the stepped flower pot collar. An accessory is interlockably and releasably mounted to the base element to support a shallow tray having an upturned peripheral side wall that may also be retained by the clamping member. A flower pot may supportably rest in the shallow tray. The accessory is also adapted to receive a supporting strand from a macrame holder, permitting it to suspend a second flower pot below the shallow tray.

17 Claims, 9 Drawing Figures

FLOWER POT HOLDER

TECHNICAL FIELD

The invention relates generally to wall mounting devices and is specifically directed to an adjustable device securable to vertical support surfaces for mounting conventional flower pots of varying size.

BACKGROUND OF THE INVENTION

The use of small potted plants has enjoyed renewed popularity in recent years in commercial and more particularly in residential settings. Although smaller decorative potted plants are still placed on horizontal support surfaces, it has become increasingly popular to elevate the plants by various mounting and suspension devices at and above eye level to enhance the beauty of a room or an external environment.

The conventional clay flower pot, although being substantially unchanged for a long period of time, continues to be one of the most widely used containers for decorative plants. The clay flower pot is generally frustoconical in shape, having its larger end open at the top with the smaller end closed except for a small drainage hole. A stepped collar extends circumferentially around the flower pot at its upper end. Clay flower pots come in varying sizes, but many have frustoconical side walls disposed at the same angle relative to the flower pot axis.

Because of the continued widespread popularity of the traditional clay flower pot, it is desirable to have a mounting device capable of rigidly supporting the relatively heavy clay flower pot and its contents, and which also is capable of being adjustable to accept flower pots of varying size.

SUMMARY OF THE INVENTION

The invention resides in a flower pot holder suitable for mounting in an elevated position on a vertical support surface, which is constructed to offer sturdy support to a clay flower pot and its contents, and which also is adjustable to receive and supportably retain flower pots of various sizes.

The preferred embodiment comprises a base member capable of vertical orientation and including first and second vertically spaced abutments each of which projects laterally outward from the front face of the base element. The upper of these two abutments serves as a supporting ledge for the stepped collar of the clay flower pot, and both abutments are sized and arranged to laterally abut the frustoconical side wall of the flower pot.

A clamping member is carried by the base member and movably adjustable relative thereto to adapt to flower pots of various sizes. The clamping member includes downwardly projecting hooking members the inner surfaces of which are angularly disposed in conformance to the angular, inner frustoconical surface of the flower pot side wall. Consequently, the clamping member may be vertically adjusted relative to the base member to define a retaining enclosure that is specifically sized for the stepped collar of the flower pot to be mounted. Because the upper abutment underlies the stepped collar and both abutments laterally engage the frustoconical side wall of the flower pot, the result is a rigidly secure mount for the flower pot.

The base and clamping members are uniquely locked in a fixed relative position by a mounting screw that secures the device to the vertical support surface. The mounting screw extends transversely through both members, compressing them together and frictionally retaining them in the desired mounting position.

The invention further comprises an accessory for the device that is adapted to support a shallow tray in which a flower pot of any configuration may be supported. The accessory is interlockably and removably mounted to the base member, extending laterally in cantilever fashion. Its upper edge defines a horizontal mounting surface for the tray, and it cooperates with the clamping member in much the same way as the upper abutment to retain the upstanding peripheral wall of the shallow tray.

Further, the accessory is provided with means for facilitating suspension of a second flower pot from a macrame holder or the like.

The inventive flower pot holder and accessory are easily mounted and used, and offer strong support to conventional clay flower pots of various sizes. With the accessory, a flower pot of any configuration may rest in a supported shallow tray, and a second flower pot may be suspended from a macrame holder.

DETAILED DESCRIPTION OF THE INVENTION

Figure 1:
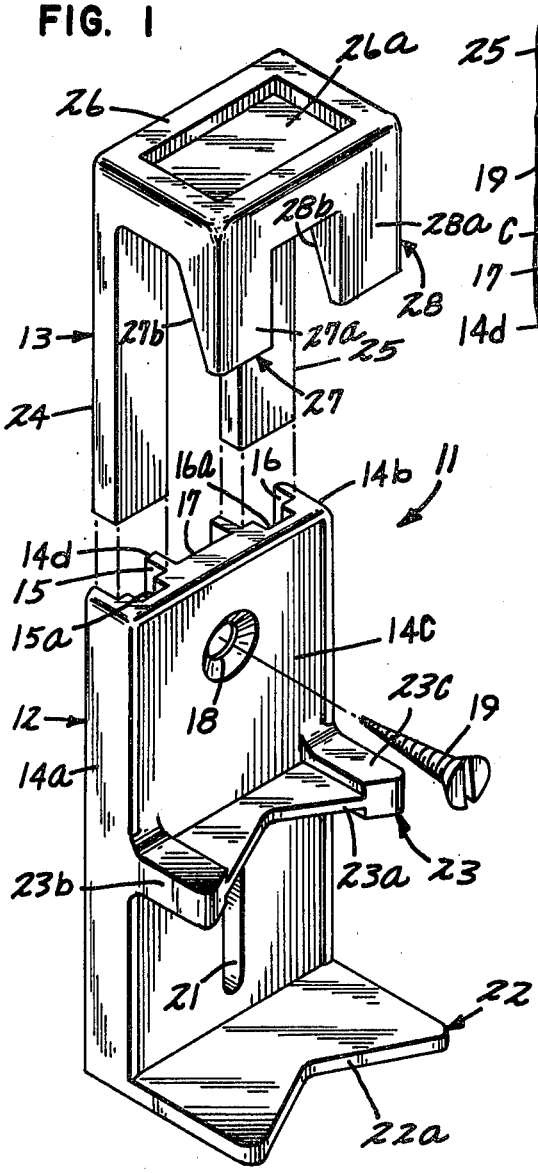
FIG. 1 is an exploded perspective of a flower pot holder embodying the invention.

With initial reference to FIG. 1, a flower pot holder represented generally by the numeral 11 is shown to comprise a base element 12 and a clamping element 13 that are relatively movable for adjustment purposes.

The base element 12 comprises a rectangular body member capable of vertical orientation and being of predetermined thickness. In the preferred embodiment, the body member includes elongated parallel sides **14*a*, 14*b*, a substantially planar front face 14*c* and a back surface 14*d***.

With continued reference to FIG. 1, three elongated grooves of rectangular cross section are formed lengthwise of the body member 14 in the back surface **14*d*. Two of these grooves, which bear the reference numerals 15, 16, are symmetrically located on each side of a center groove 17. Grooves 15, 16 are somewhat wider than the groove 17, but their effective depth is the same. With additional reference to FIG. 3, each of the elongated grooves 15, 16 has a subgroove 15***a*, 16*a* formed along its bottom surface, each of these subgrooves being of rectangular cross section but of lesser width and depth than the associated primary groove.

Figure 3:
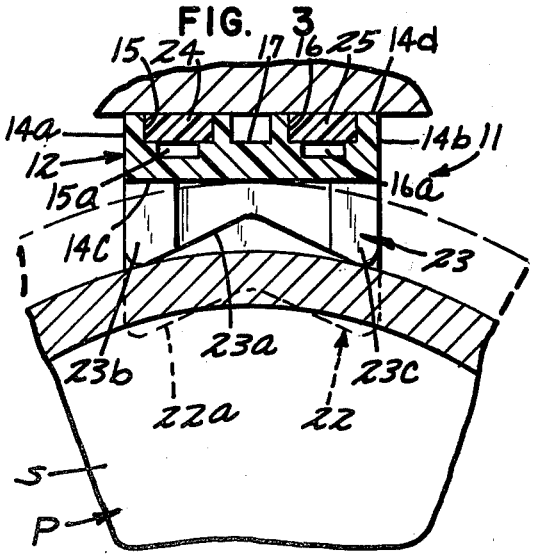
FIG. 3 is an enlarged fragmentary top sectional view of the flower pot holder and flower pot.
Figure 4:
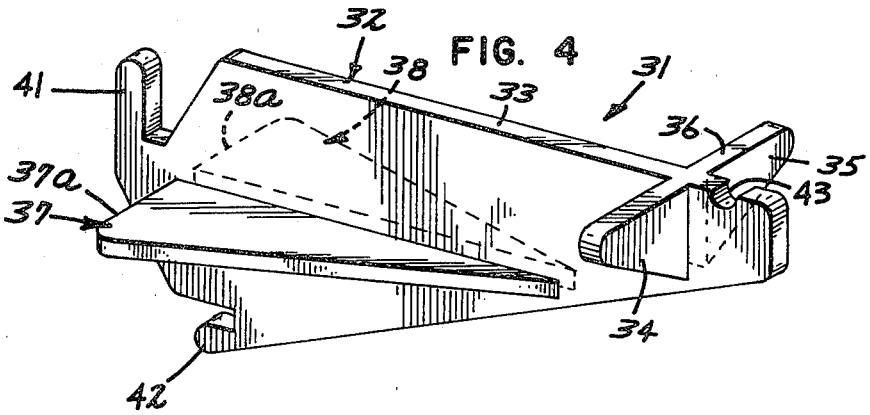
FIG. 4 is a perspective view of an accessory device usable with the flower pot holder to support a shallow tray in which a flower pot may be supportably placed.

As particularly shown in FIG. 3, the back surface 14*d* of the body member 14 is defined by the residual elongated strips between the grooves 15–17 and is planar, permitting the body member 14 to fit flush against a vertical planar surface.

A countersunk mounting aperture 18 is formed in the upper center of the body member 14, communicating with the center groove 17 and adapted to receive a conventional wood screw 19.

Figure 2:
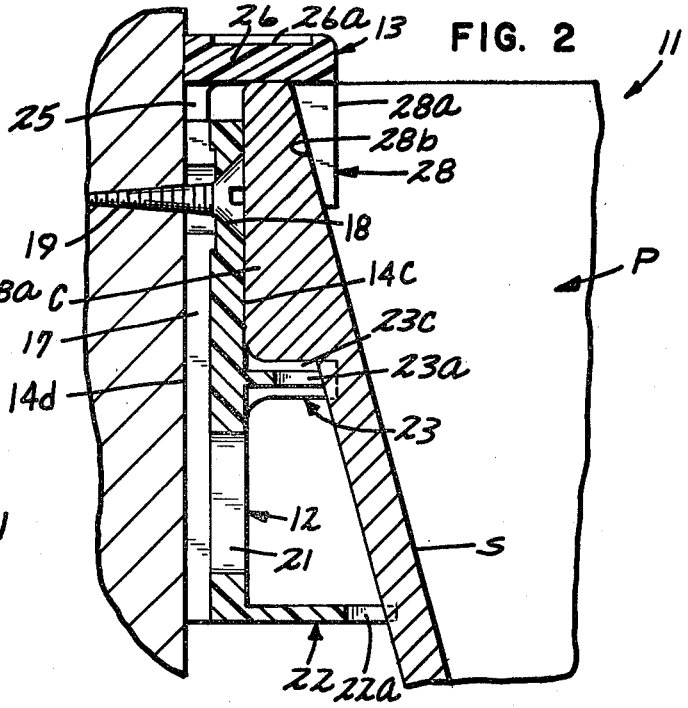
FIG. 2 is an enlarged fragmentary sectional side view of the flower pot holder, showing in particular the clamping relationship with a conventional flower pot.

With additional reference to FIG. 2, a short slot 21 is formed in the lower portion of the body member 14, extending in superimposed relation to and communication with the center groove 17. The purpose of slot 21 is described in detail below.

Projecting laterally from the front face 14*c* of body member 14 are first and second cantilevered abutments 22, 23. The abutment 22 comprises a member of uniform thickness that projects perpendicularly forward from the extreme bottom of the body member 14. The abutment 22 includes a front edge 22*a* taking the form of a shallow, symmetrical V.

The abutment 23 projects laterally from the face 14*c* at an intermediate point of the body member 14, and also defines a front edge 23*a* in the shape of a shallow, symmetrical V. Because the function of the abutment 23 is one of offering shear support as well as lateral compressive abutment support, as will become apparent below, it includes thicker reinforcements 23*b*, 23*c* along each of its sides.

With reference to FIGS. 1–3, 6 and 7, the clamping element 13 comprises a pair of legs 24, 25 that project downward in symmetrical relation from the rear edge of a rectangular top 26. A pair of angular leg members 27, 28 project downward from the leading edge of the top 26 in respective opposition to the legs 24, 25.

As particularly shown in FIG. 1, legs 24 and 25 are somewhat longer than the legs 27, 28. They are rectangular in cross section and sized to slidably fit into the grooves 15, 16 of base element 12. Preferably, the thickness of the legs 24, 25 is very slightly greater than the depth of the grooves 15, 16, which enables the base element 12 and clamping element 13 to be frictionally locked in a fixed relative position under the influence of the wood screw 19, which compresses the members 12, 13 together against the vertical supporting surface.

The top 26 has a rectangular recess 26*a* formed in its top horizontal surface for aesthetic purposes.

The legs 27, 28 are considerably shorter than the legs 24, 25, as noted above, and they are symmetrically disposed relative to each other in respective opposition to the legs 24, 25.

The legs 27, 28 have front surfaces 27*a*, 28*a* that are planar and vertically disposed with the holder 11 mounted on a vertical surface. The rear surfaces of the legs 27, 28, which bear the reference numerals 27*b*, 28*b*, are angled and converge with the surfaces 27*a*, 28*a* in the downward direction.

FIG. 2 shows a flower pot P in supported relation by the holder 11. The flower pot P is of the conventional clay type, the geometric configuration of which is frustoconical with the smaller end substantially closed by a bottom (not shown) having a small drain hole. The side S of the pot is thus angular with respect to the flower pot axis, as shown in FIG. 2, the angle being fairly uniform with clay flower pots of varying sizes. Clay flower pots also conventionally include a stepped external collar C the outer circumferential surface of which is generally parallel to the axis of the pot.

With continued reference to FIG. 2, it will be noted that the angle of the rear surfaces 27*b*, 28*b* (only the former of which is shown) corresponds directly to the angle of the sides S of flower pot P. Consequently, when the flower pot P is in the mounted position, the surfaces 27*b*, 28*b* are in flush retaining engagement with the side S.

Similarly, it will be noted that the abutments 22, 23 of the base element 12 are vertically spaced and dimensioned such that corresponding points thereof are also disposed at the angle of the side S of flower pot P. Consequently, and as shown in FIG. 2, the V-shaped forward edges 22*a*, 23*a* are simultaneously engaged by the angular side S and offer lateral support thereto.

With continued reference to FIG. 2, it will be appreciated that the clamping element 13 may be adjusted relative to the base element 12 during mounting of the holder 11 so that the angular surfaces 27*b*, 28*b* of legs 27, 28, the undersurface of top 26, the front surface 14*c* of the body member 14 and the top surface of the abutment 23 together serve as a retaining enclosure for the stepped collar C of flower pot P. Because of the length of legs 27, 28 and their vertical spacing from the abutment 23, it is possible for the collar C to be inserted into this retaining enclosure with the members 12, 13 in a fixed relative position. To accomplish this, it may be necessary for the enclosure to be slightly larger than the dimensions of the collar C. However, with the flower pot P inserted into its proper position, gravity forces the collar C against the abutment 23, and the flower pot P is prevented from movement by the surfaces 27*b*, 28*b* and the leading edges 22*a*, 23*a* of the abutments 22, 23.

A tight clamping relationship on the collar C may be obtained by lightly tapping the top of clamping element 13 after the flower pot P has been inserted into the holder.

An accessory 31 for the flower pot holder 11 is shown in FIGS. 4–9. The purpose of the accessory 31 is to cooperate with the base element 12 and clamping element 13 to permit underlying support for a shallow tray T (FIG. 5) in which a flower pot may be placed. The tray T prevents water from dripping below when the plant is watered.

Figure 9:
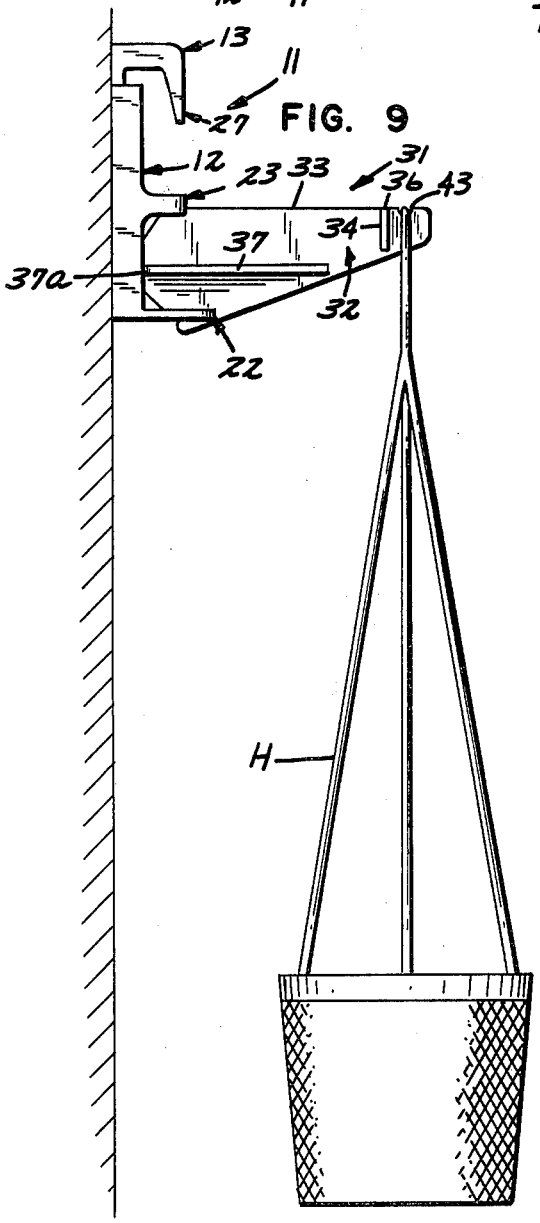
FIG. 9 is a view in side elevation of the flower pot holder and accessory mounted to a vertical surface with a flower pot suspended from the accessory.

In addition, the accessory 31 may be used to suspend a flower or plant container of any configuration through the use of a macrame holder or the like, as shown in FIG. 9.

To accomplish these objectives, the accessory is constructed for interlocking support with the base element 12 and comprises a thin, irregularly shaped (although somewhat triangular) body member 32 defining a top support edge 33 that is horizontally disposed when the accessory 31 is mounted. A pair of triangularly shaped wings 34, 35 project in laterally opposite directions from the body 32 approximate its outer end, together defining a support edge 36 that is perpendicular to the support edge 33 and coplanar therewith. The support edge 36 offers lateral stability to the tray T.

The accessory 31 further comprises a pair of triangular projections 37, 38 that extend laterally in opposite directions from the body 32. These projections 37, 38 extend lengthwise of the body member 32 along an intermediate region thereof and are themselves horizontally disposed. These projections define rear edges 37*a*, 38*a* that respectively abut the front face 14*c* of the base element 12 in assembled relation (see FIGS. 8 and 9), assisting in the cantilevered support of accessory 31 as described in further detail below.

Figure 5:
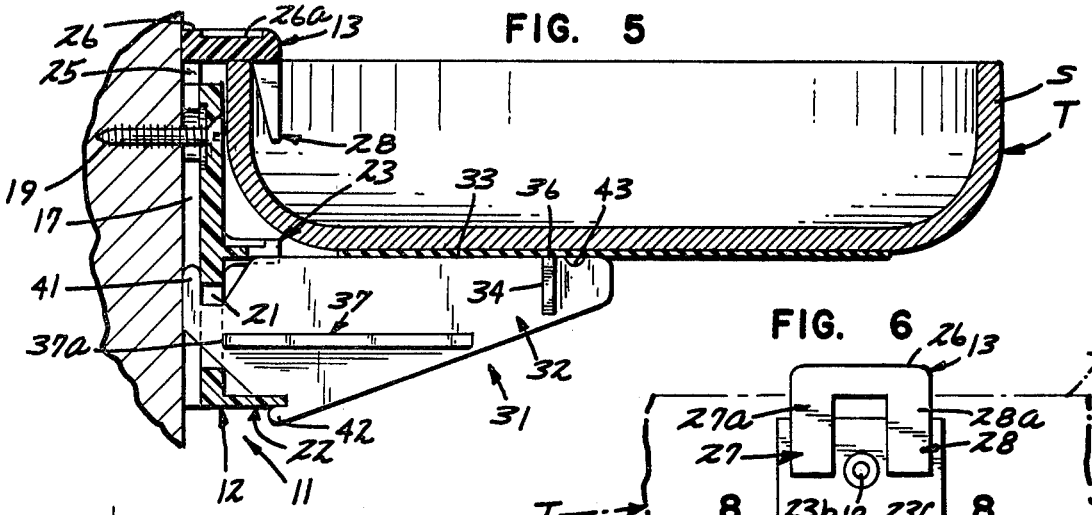
FIG. 5 is a fragmentary side sectional view of the flower pot holder and accessory device with a shallow tray in a supported position.
Figure 6:
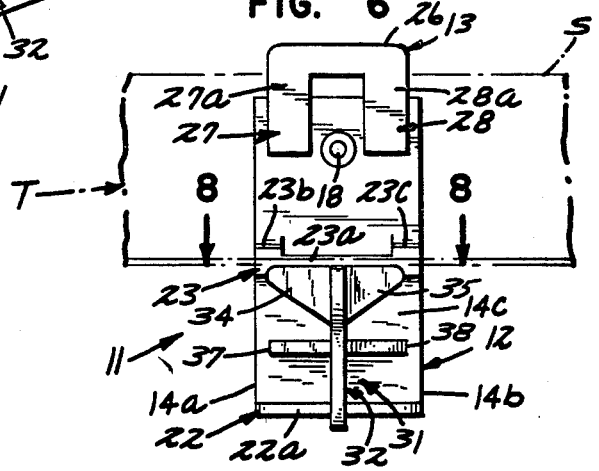
FIG. 6 is a view in front elevation of the flower pot holder and accessory device with the shallow tray represented by phantom lines.
Figure 7:
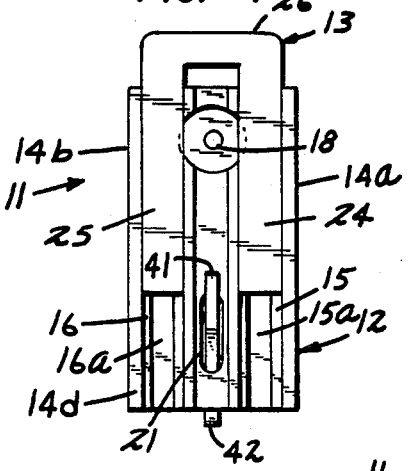
FIG. 7 is a view in rear elevation of the flower pot holder and accessory.
Figure 8:
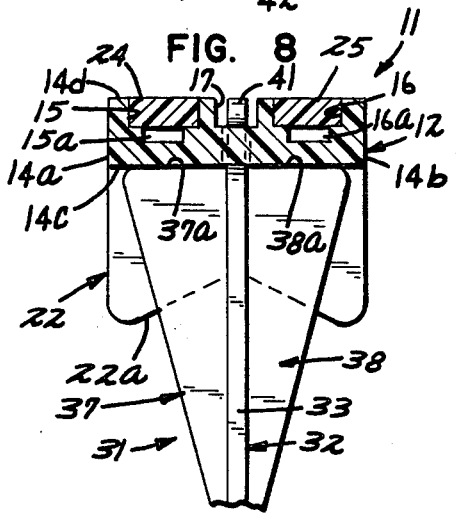
FIG. 8 is a fragmentary sectional view taken along the line 8—8 of FIG. 6.

The rear edge of body member 32 defines an upwardly projecting hooking member 41 and a rearwardly projecting hooking member 42 that together interlockably cooperate with the base member 12 to support the accessory 31. As shown in FIGS. 5, 7 and 8, the hooking member 41 is sized and constructed for insertion through the vertical slot 21 in the body member 14 and into the center groove 17. In this regard, the width of the hooking member 41 is slightly less than the width of the slot 21, and its depth corresponds to the depth of the groove 17 so that its rear edge is substantially coplanar with the back surface 14*d* of body member 14. As particularly shown in FIG. 5, the top of hooking member 41 extends slightly above the top of slot 21 to assist in supporting the accessory 31 and preventing it from tilting forward and downward.

The hooking member 42 is disposed below and forwardly of the hooking member 41, and it is sized and arranged to interlock with the abutment 22 at the valley of the V-shaped edge 22*a*. As shown in FIG. 5, the slot defined between the hooking member 42 and the main portion of body 32 corresponds to the thickness of the abutment 22 so that it fits snugly over the abutment 22 in the assembled position.

As constructed, the accessory 31 interlocks with the base member 12 through the hooking members 41, 42, and additional support is offered by the abutting engagement between the rear edges 37*a*, 38*a* of the triangular projections 37, 38 with the front face 14*c* of body member 14. In this interlocked relationship, the accessory 31 is rigidly (although removably) secured in cantilevered fashion, and offers firm underlying support to the tray T. In this regard, the tray T has a short upstanding peripheral side wall S that is inserted into and retained by the enclosure defined between the clamping member 13 and base element 12.

A small notch 43 is formed in the edge 33 just outwardly of the edge 36. The notch receives a supporting strand of a macrame hanger H (FIG. 9) without interfering with the flat underlying relationship between the edges 33, 36 and the bottom surface of the tray T.

In the preferred embodiment, the base element 12, clamping element 13 and the accessory 31 are each integrally formed by an injection plastic process. The various plastic components are capable of resiliently yielding to a degree to permit entry of the collar C into the retaining enclosure, and also to permit interlocking insertion of the accessory 31 into the base element 12.

The flower pot holder 11 is easily used to hold a flower pot P rigidly and securely, and also is capable of being adjusted to receive flower pots of different size. The accessory 31 may be added with the holder 11 in a mounted position, and enhances usage of the device by offering two additional and different manners of supporting plants.

What is claimed is:

1. A device for releasably mounting a flower pot having a frustoconical side wall and a stepped collar at the top of the side wall, the device comprising:

(a) a base member capable of vertical orientation and defining front and back faces, the base member comprising (i) first and second abutment means projecting laterally from said front face in vertical spaced relation;

(ii) the first abutment means being constructed and disposed to underlie and engageably support the bottom edge of said stepped collar;

(iii) the second abutment means being constructed and disposed to be engaged by and laterally support the frustoconical wall of the flower pot;

(b) and clamping means associated with the base member, the clamping means being movably adjustable relative to the base member to define a retaining enclosure with said first abutment means;

(c) and locking means for maintaining the clamping means and support means in a predetermined fixed relative position.

2. The device defined by claim 1, which further comprises mounting means for mounting the device to a substantially vertical support surface.

3. The device defined by claim 2, wherein the mounting means comprises said locking means.

4. The device defined by claim 1, wherein the clamping means is constructed and disposed for vertically adjustable movement relative to the base member, and comprises a downwardly projecting hook disposed in overlying relation to the first abutment means and spaced therefrom to permit entry of the stepped collar therebetween.

5. The device defined by claim 4, wherein the projecting hook defines an inner surface engageable with the inner frustoconical surface of the flower pot, said inner surface being angularly disposed in conformance to the angle of said frustoconical side wall.

6. The device defined by claims 1 or 5, wherein the first and second abutment means are constructed and relatively disposed so that the flower pot engaging portions thereof together subtend an angle that conforms to the angle of said frustoconical side wall.

7. The device defined by claim 6, wherein the flower pot engaging portion of each of said abutment means comprises a V-shaped edge constructed and disposed to accommodate the frustoconical side wall of the flower pot.

8. The device defined by claim 4, wherein the base member comprises upper and lower ends, the projecting hook being disposed proximate the upper end and adjustably movable with respect thereto.

9. The device defined by claim 8, wherein the first abutment means is disposed intermediate the upper and lower ends of the base member, and the second abutment means is disposed proximate the lower end thereof.

10. The device defined by claim 8, wherein:

(a) the base member comprises at least one vertical groove disposed in the back face thereof;

(b) the clamping means further comprises at least one downwardly projecting leg member constructed and arranged to slide in said vertical groove;

(c) and the locking means is constructed and arranged to frictionally compress said leg member in said vertical groove.

11. The device defined by claim 10, which further comprises means for mounting the device to a substantially vertical support surface.

12. The device defined by claim 11, wherein the locking means and mounting means comprise screw means passing transversely through the base member proximate the vertical groove and leg member, whereby entry of the screw means into said vertical support surface effects said frictional compression.

13. The device defined by claim 12, wherein:

(a) the clamping means comprises a pair of said downwardly projecting hooks and a pair of said downwardly projecting leg members respectively disposed in opposition to the hooks;

(b) the base member comprises a pair of said vertical grooves;

(c) and the screw means extends transversely through the base member between said vertical grooves.

14. The device defined by claim 1, which further comprises accessory means releasably mounted to said base member and projecting laterally therefrom in cantilever fashion, the accessory means defining a horizontal support surface spaced from the clamping means to supportably underlie a shallow tray having an upturned peripheral retaining wall.

15. The device defined by claim 14, wherein the accessory means comprises first and second hooking means constructed and arranged to respectively interlock with the base member and the second abutment means.

16. The device defined by claim 15, wherein the horizontal support surface of said accessory means is defined by a first elongated edge extending laterally of the base member, and a second edge extending transversely of the first edge, the first and second edges being coplanar.

17. The device defined by claim 16, wherein the accessory means further comprises a notch formed in said first edge proximate its outer end.

* * * * *